US005786657A

United States Patent [19]

Okamoto

[11] Patent Number: 5,786,657

[45] Date of Patent: Jul. 28, 1998

[54] FIELD EMISSION ELECTRON GUN CAPABLE OF MINIMIZING NONUNIFORM INFLUENCE OF SURROUNDING ELECTRIC POTENTIAL CONDITION ON ELECTRONS EMITTED FROM EMITTERS

[75] Inventor: Akihiko Okamoto, Tokyo, Japan

[73] Assignee: NEC Corporation, Tokyo, Japan

[21] Appl. No.: 840,763

[22] Filed: Apr. 16, 1997

[30] Foreign Application Priority Data

Apr. 16, 1996 [JP] Japan ..... 8-094427

[51] Int. Cl.[6] ..... H01J 9/02

[52] U.S. Cl. ..... 313/308; 313/307; 313/309; 313/336; 313/351; 315/325; 315/349; 315/341

[58] Field of Search ..... 313/308, 307, 313/309, 336, 351, 497; 315/324, 325, 334, 339, 349, 109.4, 341

[56] References Cited

U.S. PATENT DOCUMENTS 4,578,614 3/1986 Gray et al. ..... 313/309
5,666,024 9/1997 Vickers ..... 313/309 X

FOREIGN PATENT DOCUMENTS 5-242794 9/1993 Japan .
5-266806 10/1993 Japan .
5-343000 12/1993 Japan .
7-29484 1/1995 Japan .

*Primary Examiner*—Ashok Patel
*Attorney, Agent, or Firm*—Sughrue, Mion, Zinn, Macpeak & Seas, PLLC

[57] ABSTRACT

In a field emission electron gun including emitters (104) on predetermined parts of a substrate (409), an insulator film (105) on a remaining part of the substrate, a first gate electrode (101) on the insulator film so as to surround the emitters with a space left between each emitter and the first gate electrode, the emitters are formed on the substrate except a center part of the substrate. The first gate electrode has an inner peripheral surface which defines a hole (107) exposing a center portion of the insulator film that is positioned on the center part of the substrate. A second gate electrode (102) is formed on the insulator film to surround an outer peripheral surface of the first gate electrode with a distance left between the outer peripheral surface of the first gate electrode and the second gate electrode. A third gate electrode (106) may be formed on the center portion of the insulator film with another distance left between the inner peripheral surface of the first gate electrode and the third gate electrode.

11 Claims, 6 Drawing Sheets

FIG. 4A
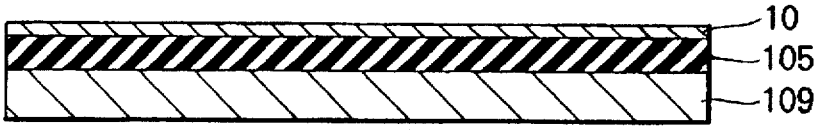
FIG. 4B
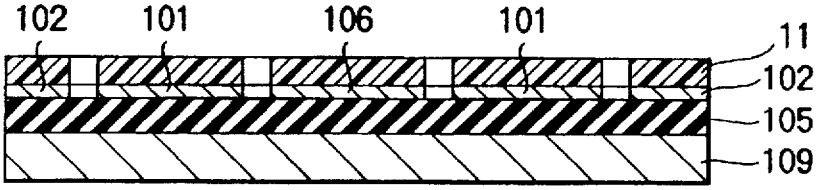
FIG. 4C
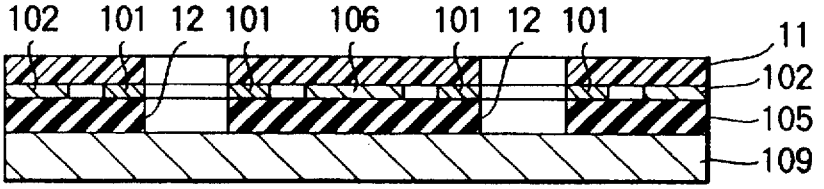
FIG. 4D
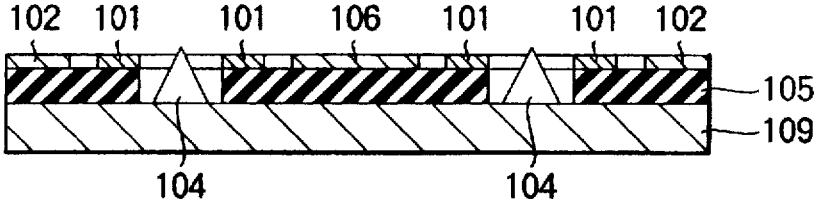
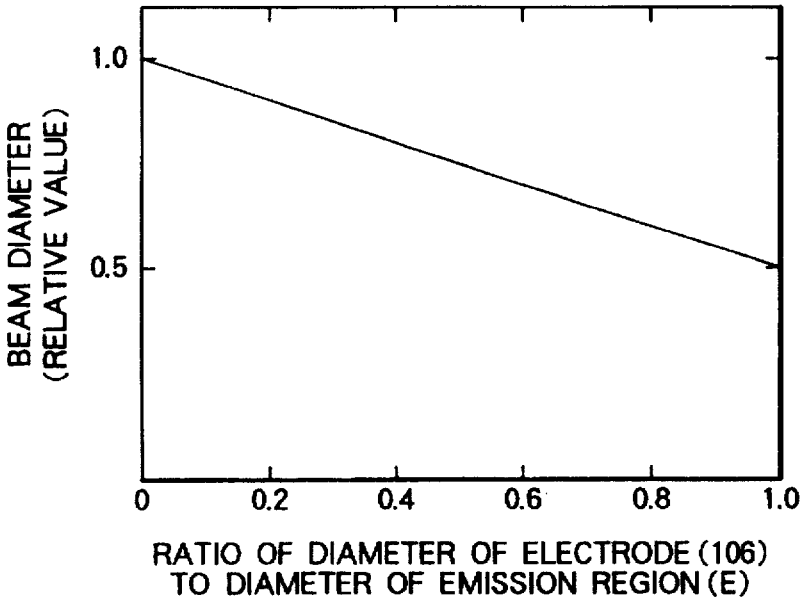
FIG. 5

FIELD EMISSION ELECTRON GUN CAPABLE OF MINIMIZING NONUNIFORM INFLUENCE OF SURROUNDING ELECTRIC POTENTIAL CONDITION ON ELECTRONS EMITTED FROM EMITTERS

BACKGROUND OF THE INVENTION

This invention relates to a field emission electron gun including a plurality of sharp-pointed emitters.

A field emission electron gun includes an emitter of a sharp pointed shape for concentrating an electric field, a gate electrode arranged in the vicinity of the emitter, and an anode electrode. In the field emission electron gun, a total current can be increased by integrating a plurality of emitters.

The field emission electron gun is employed for a wide range of applications. If the field emission electron gun is used in a planar display device, a fluorescent member is located at a distance on the order of lmm from the electron gun. Electrons are emitted from the emitters as an electron beam towards the fluorescent member.

Naturally, the electron beam is emitted with a particular diverging angle. If the diverging angle is large, the electron beam can not form a sufficiently small diameter or cross-sectional area on the fluorescent member. This decreases the luminance of the fluorescent member.

Empirically, it has been confirmed that the diverging angle ranges between 20 and 30 degrees. In order to assure a sufficient luminance, various proposals have been made to suppress the diverging angle. For example, Japanese Unexamined Patent Publications (JP-A) Nos. 343000/1993, 242794/1993, 266806/1993, and 29484/1995 disclose the use of a deflection electrode or a focusing electrode to cause repulsion of electrons so as to suppress the divergence of the electron beam.

As will later be described, a conventional field emission electron gun is incapable of minimizing nonuniform influence of a surrounding electric potential condition on electrons emitted from emitters.

SUMMARY OF THE INVENTION

It is therefore an object of this invention to provide a field emission electron gun capable of minimizing nonuniform influence of a surrounding electric potential condition on electrons emitted from emitters of an emission region.

It is another object of this invention to provide a field emission electron gun of the type described, which is capable of achieving a uniform electron emission characteristic in common to the emitters of the emission region.

Other objects of this invention will become clear as the description proceeds.

A field emission electron gun to which this invention is applicable comprises: a substrate of a conductive material; a plurality of emitters, each of which is of a sharp pointed shape and which are formed on a plurality of predetermined parts of the substrate for emitting electrons; an insulator film formed on a remaining part of the substrate; a first gate electrode which is formed on the insulator film so as to surround the emitters with a space left between each of the emitters and the first gate electrode and which is applied with a first voltage; and a second gate electrode which is formed on the insulator film to surround an outer peripheral surface of the first gate electrode with a distance left between the outer peripheral surface of the first gate electrode and the second gate electrode and which is applied with a second voltage less than the first voltage.

According to this invention, the emitters are formed on the substrate except a center part of the substrate. The first gate electrode has an inner peripheral surface which defines a hole exposing a center portion of the insulator film that is positioned on the center part of the substrate.

Preferably, a third gate electrode is formed on the center portion of the insulator film with another distance left between the inner peripheral surface of the first gate electrode and the third gate electrode and which is applied with a third voltage less than the first voltage.

By appropriately selecting the size of the hole and the voltage applied to the third electrode, it is possible to minimize nonuniform influence of a surrounding electric potential condition on electrons emitted from the emitters of an emission region and to control so that emission characteristics of the individual electrons become uniform.

BRIEF DESCRIPTION OF THE DRAWING

FIGS. 4A through 4D are sectional views for use in describing a manufacturing process of the field emission electron gun illustrated in FIG. 2;

FIG. 5 is a graph showing a simulation result of the field emission electron gun manufactured by the process illustrated in FIGS. 4A through 4D;

DESCRIPTION OF THE PREFERRED EMBODIMENTS

Figure 1:
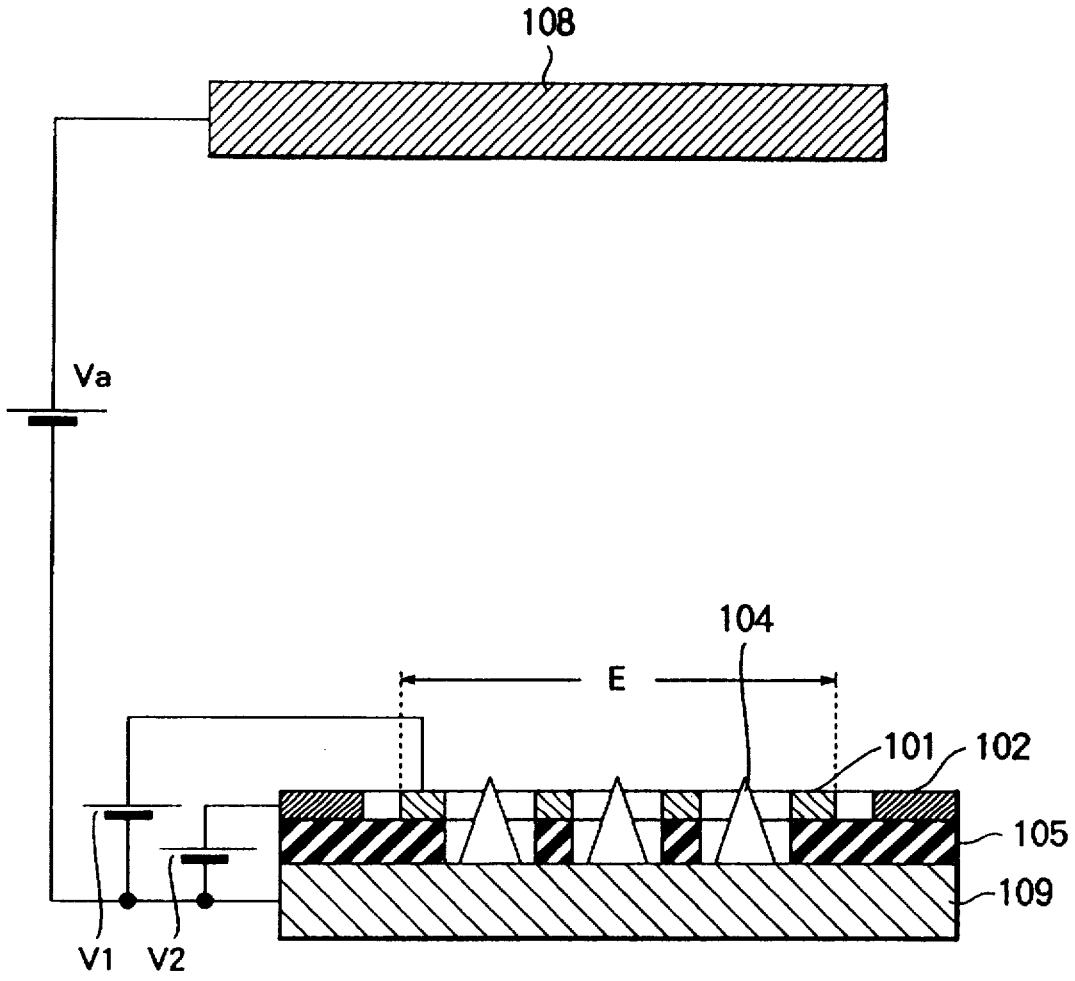
FIG. 1 PRIOR ART
FIG. 1 is a sectional view of a conventional field emission electron gun.

Referring to FIG. 1, a conventional field emission electron gun will first be described for a better understanding of this invention. The field emission electron gun is equivalent to the conventional field emission electron gun described in the preamble of the instant specification and has a double gate structure.

The field emission electron gun includes a substrate 109 of a conductive material of, for example, silicon (Si). The conductive material may be either a different semiconductor or a conductor. A plurality of emitters 104, each of which is of a sharp-pointed cone shape, are formed on a plurality of predetermined parts of the substrate 109 for emitting electrons. An insulator film 105 is formed on a remaining part of the substrate 109.

A first gate electrode (or an extracting electrode) 101 of a metal film is formed on the insulator film 105 so as to surround the emitters 104 with a space left between each of the emitters 104 and the first gate electrode 101. The first gate electrode 101 is applied with a first voltage V1.

A second gate electrode (or a focusing electrode) 102 of a metal film is formed on the insulator film 105 to surround an outer peripheral surface of the first gate electrode 101 with a distance (or a gap) left between the outer peripheral surface of the first gate electrode 101 and the second gate electrode 102. The second electrode 102 is applied with a second voltage V2. The second voltage V2 is less than the first voltage V1.

An anode electrode 108 is arranged above the first and the second gate electrodes 101 and 102. The anode electrode 102 is applied with a different voltage Va.

A first power supply of the first voltage V1 is connected between the substrate 109 and the first gate electrode 101. A second power supply of the second voltage V2 is connected between the substrate 109 and the second gate electrode 102. Inasmuch as a voltage drop in the substrate 109 is substantially negligible, it is understood that the first voltage V1 is applied between the emitters 104 and the first gate electrode 101 and that the second voltage V2 is applied between the emitters 104 and the second gate electrode 102. A different power supply of the voltage Va is connected between the substrate 109 and the anode electrode 108.

Electrons emitted from the tip of each emitter 104 are deflected by the second gate electrode 102. After passing through the first gate electrode 101, the electrons are accelerated by an anode potential of the anode electrode 108. Finally, the electrons are focused on the anode electrode 108 as an electron beam.

In the above-described field emission electron gun, the electrons emitted from the tip of each emitter 104 are deflected by the second gate electrode 102 having an electric potential lower than the first voltage V1 of the first gate electrode 101. Since a plurality of the emitters 104 are surrounded by the single second gate electrode 102, a dispositional relationship between each individual emitter 104 and the second gate electrode 102 is different in dependence upon the location of each individual emitter 104. The emitters 104 are arranged within an emission region E which is defined by the outer peripheral surface of the first gate electrode 101. The emitters 104 located in a central part and a peripheral part of the emission region E will be referred to as inner emitters and outer emitters, respectively. The influence by the second gate electrode 102 is greatly different between the electrons emitted from the inner emitters 104 and those emitted from the outer emitters 104. Specifically, the electrons emitted from the outer emitters 104 nearer to the second gate electrode 102 are under a greater influence from the second gate electrode 102.

The first and the second gate electrodes 101 and 102 must be electrically isolated. To this end, the first and the second gate electrodes 101 and 102 are spatially separated from each other to form a gap therebetween, as illustrated in FIG. 1. Through the gap, the electrons are affected by an electric potential of the substrate 109.

Particularly, in the peripheral part of the emission region E, the electrons are affected by electric potentials of the inner emitters 104 arranged in the central part. On the other hand, the outer peripheral surface of the first gate electrode 101 is present in the peripheral part of the emission region E. In addition, the gap between the first and the second gate electrodes 101 and 102 is present in an outer side of the outer peripheral surface of the first gate electrode 101. The second gate electrode 102 is located outside of the gap.

With the above-mentioned structure, the electrons are subjected to internal repulsion from the inner emitters 104 kept at the electric potential lower than that of the first gate electrode 101. In addition, the electrons are subjected to external repulsion from the gap having an electric potential lower than that of the first gate electrode 101. It is noted here that the repulsion to which the electrons are subjected from the gap, is dependent upon a distance from the outer peripheral surface of the first gate electrode 101. If the distance is great, the influence of the repulsion will be small.

Thus, the field emission electron gun is inevitably subjected to nonuniform influence of a surrounding electric potential condition on the electrons emitted from the emitters 104 arranged in the emission region E.

Figure 2:
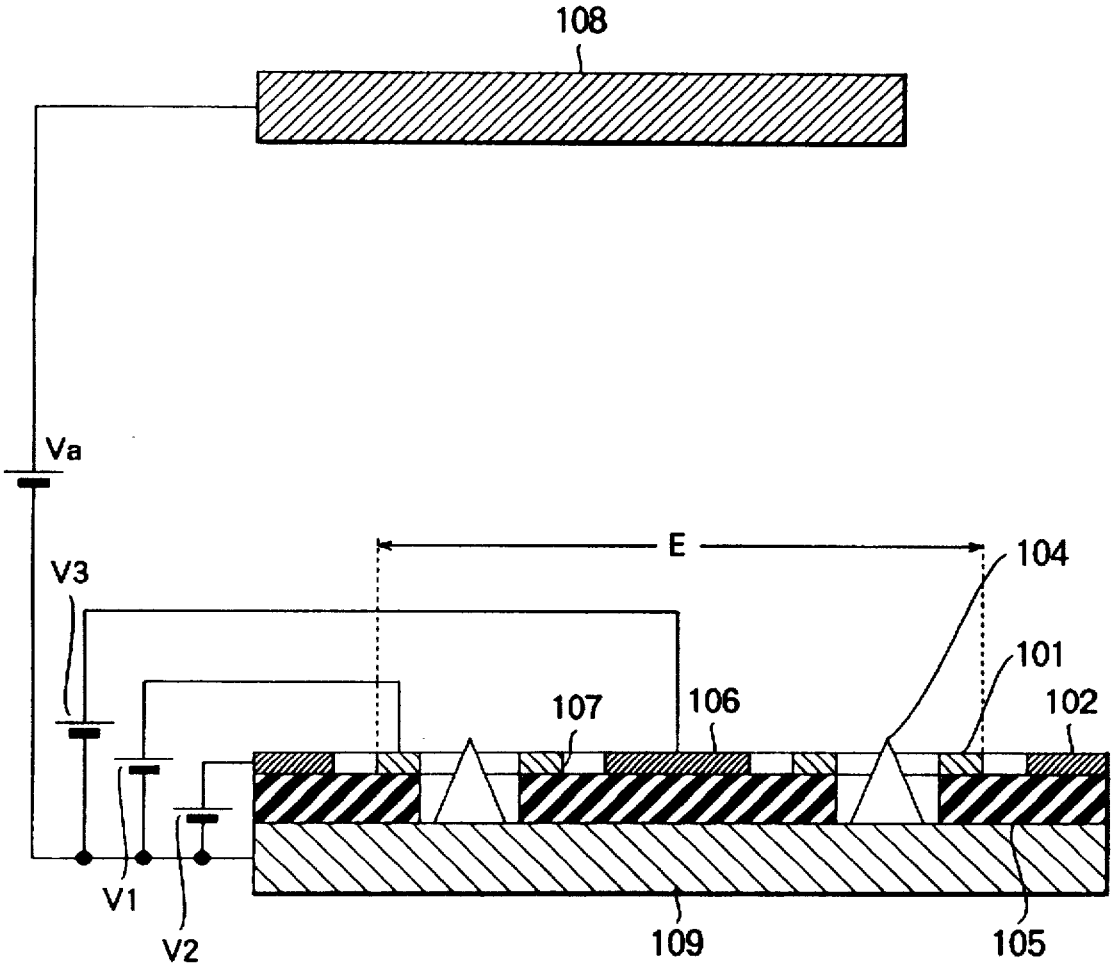
FIG. 2 is a sectional view of a field emission electron gun according to a first embodiment of this invention.
Figure 3:
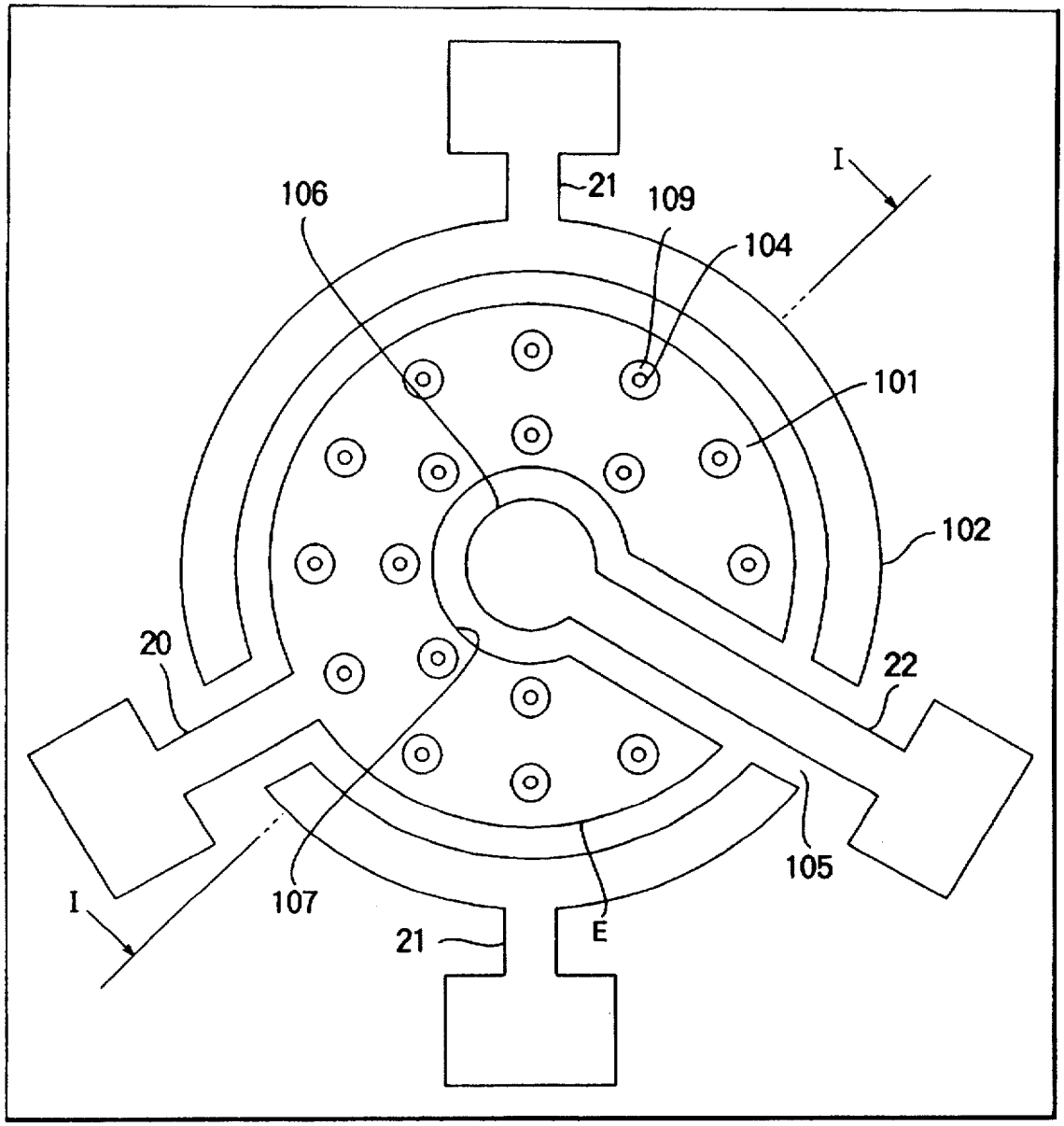
FIG. 3 is a plan view of the field emission electron gun illustrated in FIG. 2.

Turning to FIGS. 2 and 3, illustration is made of a field emission electron gun according to a first embodiment of this invention. FIG. 2 is a sectional view taken along a I—I line of FIG. 3.

In FIGS. 2 and 3, the field,emission electron gun is similar to the field emission electron gun of FIG. 1 except for the following. That is, the emitters 104 are formed on the substrate 109 except a center part of the substrate 109. In this event, the emitters 104 are arranged on the substrate 109 to form a plurality-of rings around the center part of the substrate 109.

The first gate electrode 101 has an inner peripheral surface which defines a hole 107 exposing a. center portion of the insulator film 105. The center portion of the insulator film 105 is positioned on the center part of the substrate 109.

A third gate electrode (or an inner focusing electrode) 106 of a metal film is formed on the center portion of the insulator film 105 with another distance left between the inner peripheral surface of the first gate electrode 101 and the third gate electrode 106. The third gate electrode 106 is applied with a third voltage V3 less than the first voltage V1. Preferably, the third voltage V3 is equal to or less than the second voltage V2 as will later be described. A third power supply of the third voltage V3 is connected between the substrate 109 and the third gate electrode 106.

The second and the third gate electrodes 102 and 106 are independently voltage-controlled by individual power supplies. Electrons emitted from the tip of each emitter 104 are deflected by the second gate electrode 102. After passing through the first gate electrode 101, the electrons are accelerated by an anode potential of the anode electrode 108. Finally, the electrons are focused on the anode electrode 108 as an electron beam. In order to suppress the divergence of the electrons, the second voltage (or a focusing voltage) V2 and the third voltage V3 (or a inner focusing voltage) are selected to be smaller than the gate voltage V1.

Inasmuch as the influence of the third voltage (the inner focusing voltage) V3 for the first gate electrode 101 is greater than the influence of the second voltage (the focusing voltage) V2, the third voltage (the inner focusing voltage) V3 is preferably equal to or smaller than the second voltage (the focusing voltage) V2.

In FIG. 3, the emitters 104 are arranged within the emission region E having a diameter of 50 μm to form a plurality of rings around a center part of the emission region E. The second electrode 2 has a circular ring shape. The first and the third electrode 101 and 106 are connected to lead lines 20 and 22, respectively. The second electrode 102 is connected to a pair of lead lines 21.

Referring to FIGS. 4A through 4D, description will be made about a manufacturing process of the field emission electron gun of FIG. 2.

At first referring to FIG. 4A, the insulator film 105 is deposited on the substrate 109 to a thickness of 500 nm. The insulator film 105 may comprise a single layer or a plurality of layers of silicon dioxide or silicon nitride. Then, for use as the first gate electrode 101 (FIG. 2), the second gate electrode 102 (FIG. 2), and the third gate electrode 106 (FIG. 2), a tungsten silicide film 10 is deposited on the insulator film 105 to a thickness of 200 nm. Instead of the tungsten silicide film 10, use may be made of a film of aluminum, niobium, tungsten, or the like.

Next referring to FIG. 4B, a photo-resist film 11 is applied on the tungsten silicide film 10. Thereafter, the first gate electrode 101, the second gate electrode 102, and the third gate electrode 106 are separately formed by a known technique such as photolithography.

After the photo-resist film 11 is again applied, a plurality of gate holes 12 are formed to locally expose the surface of the substrate 109, as illustrated in FIG. 4C.

As illustrated in FIG. 4D, the emitters 4 are formed in-the gate holes 12, respectively.

In the manufacturing process described above, the first gate electrode 101, the second gate electrode 102, and the third gate electrode 106 are simultaneously formed from the tungsten silicide film 10 of 200 nm thick. Thus, the manufacturing process is simple.

FIG. 5 shows a simulation result obtained by the field emission electron gun manufactured by the above-described process. It is assumed here that each emitter 104 has a diameter of 1.2 μm. The emission region E has a diameter of 50 μm. The gap between the first and the second gate electrodes 101 and 102 is equal to 5 μm. A marginal distance between the gap and the outermost emitters 104 or the innermost emitters 4 is equal to 5 μm. The first voltage V1 and the second voltage V2 are equal to 70 V and 50 V, respectively. The relationship between the second voltage V2 and the third voltage V3 is optimized. Under the above-mentioned condition, the diameter of the third gate electrode 106 is varied between 1 and 45 μm.

In FIG. 5, an abscissa represents a ratio of the diameter of the third gate electrode 106 to the diameter of the emission region E while an ordinate represents a beam diameter detected by a fluorescent member located 1 mm above the emitters 104. Herein, the beam diameter is given as a relative value assuming that the beam diameter is equal to unity in case where the third gate electrode 106 is not formed, namely, where the above-mentioned ratio is equal to zero.

As seen from FIG. 5, the beam diameter linearly reduces with an increase of the above-mentioned ratio. Thus, the dependency of the beam diameter upon the diameter of the third gate electrode 106 is proved. It will be understood from FIG. 5 that the divergence of the electrons emitted from the emitters 104 is suppressed by increasing the diameter of the third gate electrode 106. Although the gap interval is equal to 5 μm and the marginal distance is equal to 5 μm in the foregoing description, these dimensions can be changed in conformity with the diameter of the emitters 104. Preferably, the gap interval and the marginal distance are selected within a range between 1 and 20 μm.

Figure 6:
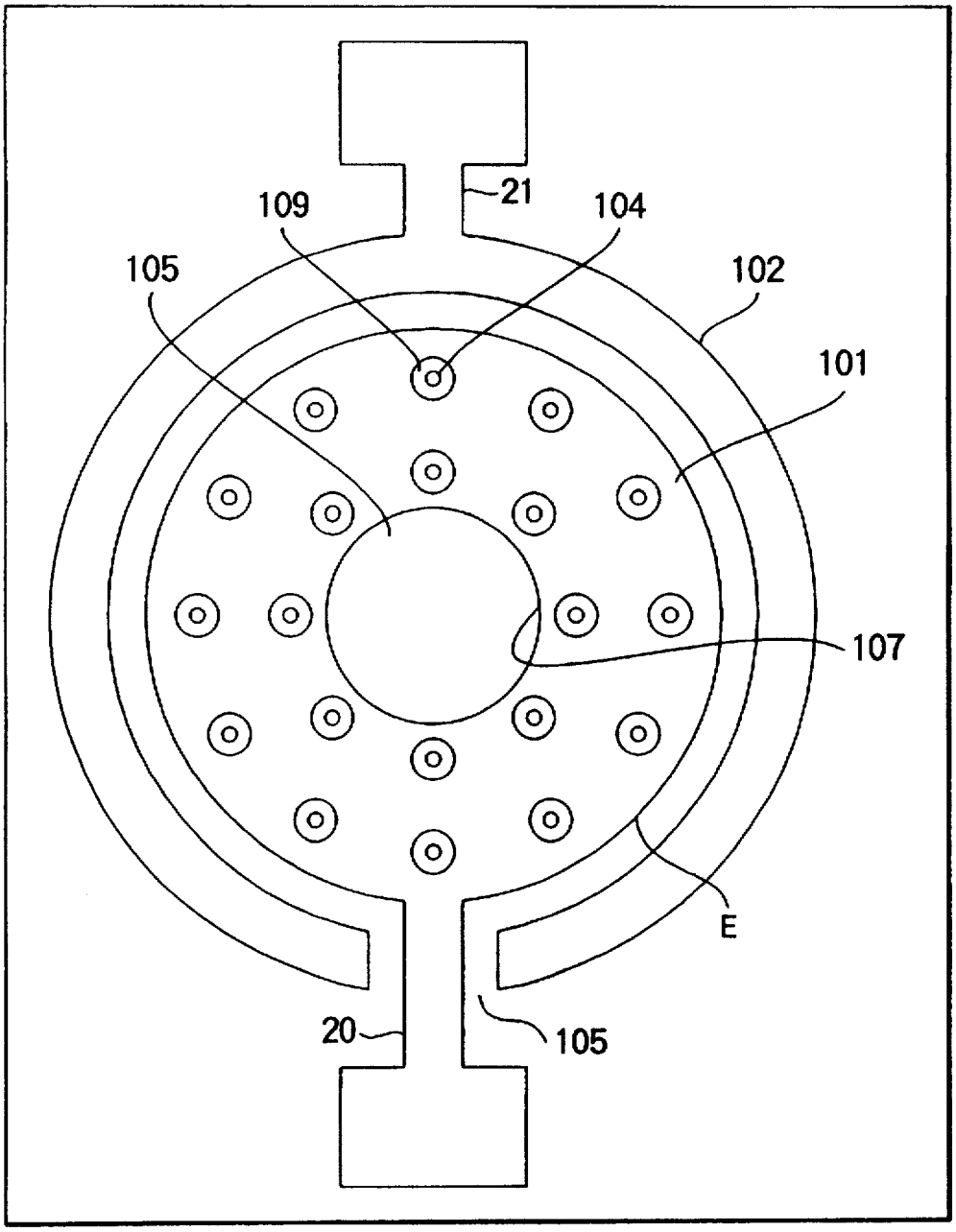
FIG. 6 is a plan view of a field emission electron gun according to a second embodiment of this invention.

Referring to FIG. 6, a field emission electron gun according to a second embodiment of this invention is different from the first embodiment in that the third gate electrode 106 and the lead line 22 are omitted. Specifically, the hole 107, which is defined by the inner peripheral surface of the first gate electrode 101, exposes the center portion of the insulator film 105. In the second embodiment, the electrons emitted from the emitters are affected by an electric potential of the substrate 109 through the insulator film 105.

By optimizing the first voltage V1 and the diameter of the hole 107, the above-mentioned structure without the third gate electrode 106 achieves the similar effect as in the first embodiment. Because the lead line 22 for the third gate electrode 106 is no longer necessary, the emitters 104 can be arranged in a symmetrical or a circular pattern. It is thus possible to form the electron beam having a symmetrical or a circular section.

Figure 7:
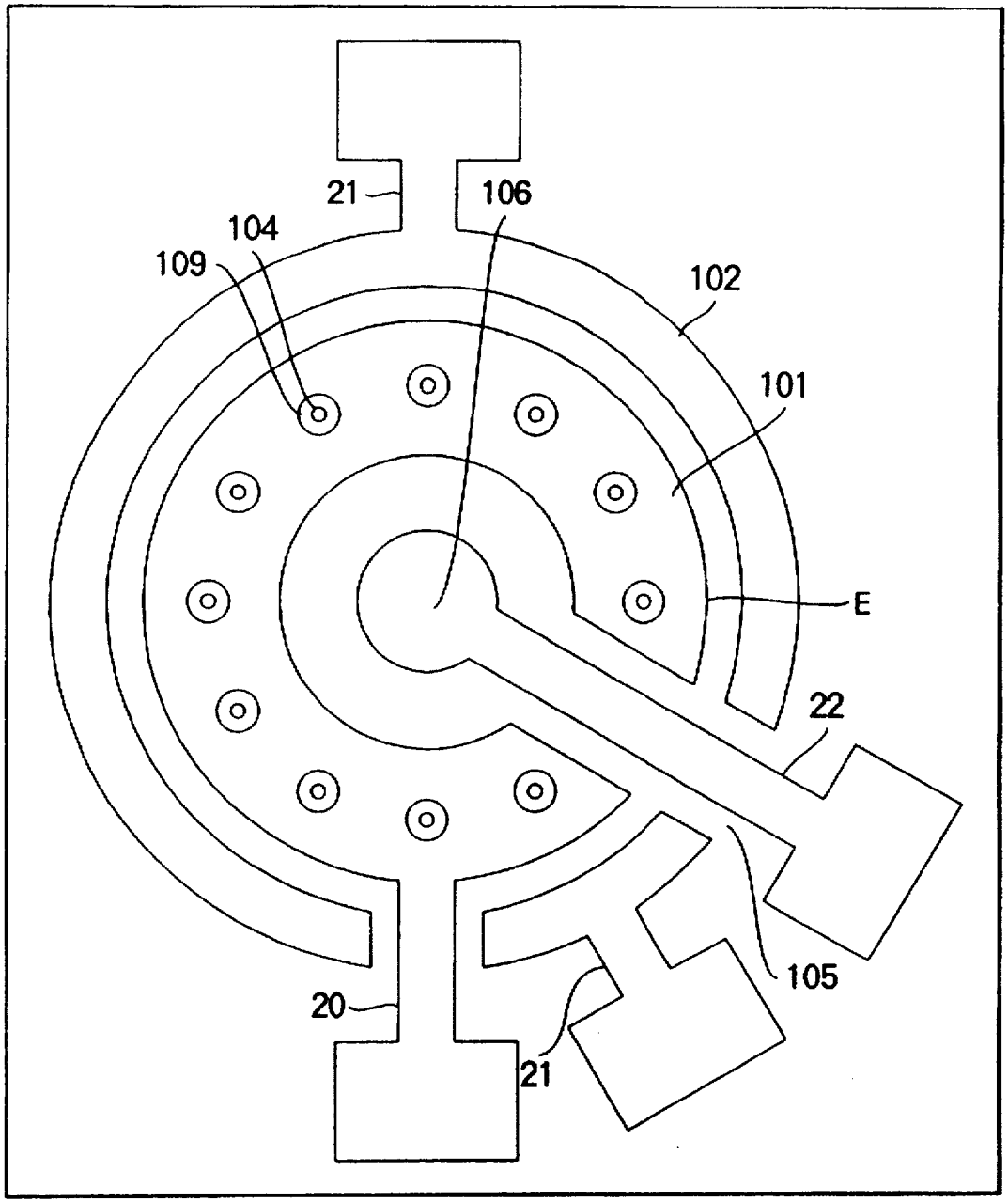
FIG. 7 is a plan view of a field emission electron gun according to a third embodiment of this invention.

Referring to FIG. 7, a field emission electron gun according to a third embodiment of this invention is similar in structure to the first embodiment except the arrangement of the emitters 104 which will later be described. The remaining portion will not be described any longer.

In the third embodiment, the emitters 104 are arranged on the substrate 109 to form a single ring around the center part of the substrate 109. Since both the second gate electrode (the focusing electrode) 102 and the third gate electrode (the inner focusing electrode) 106 can be located close to each emitter 104, the focusing effect is increased.

In the meanwhile, in a vacuum, positive ions or radicals come from the anode electrode 8 towards the emitters 4 and collide with the emitters 4. Such collision often causes undesired discharge to occur. In case where a lens system has an axially symmetrical structure, for example, the positive ions or radicals are concentrated at the center of the emitters 104. In each of the above-mentioned structure, the ions arrive at the third gate electrode 106 or the hole 107 without collision with the emitters 104. Thus, this invention is advantageous in view of an increase of lifetime also.

It will be understood that the third gate electrode 106 or the hole 107 may have any appropriate shape other than the circular shape in the foregoing description. For example, a rectangular groove may be used instead. The size of the third gate electrode 106 or the hole 107 can be selected in conformity with the emission condition. The material and the thickness of each of the first gate electrode 1011 the second gate electrode 102, and the third gate electrode 106 are not restricted to those specified above.

As thus far been described, according to this invention, either only the hole 107 or a combination of the hole 107 and the third gate electrode 106 is formed at the center of the emission region E. With this structure, it is possible to achieve a uniform travelling direction for both the electrons emitted from the emitters 104 located at the central part and those from the emitters 104 located at the peripheral part.

In the prior art, the electrons emitted from the individual emitters have the diverging angle and the travelling direction differs in dependence upon the position of the individual emitters. Therefore, a high-density current can not be obtained. On the other hand, it is possible according to this invention to focus the electrons emitted from the emission region occupying a relatively large space.

Therefore, the emitter region can be increased so as to realize the high-density current beam.

What is claimed is:

1. A field emission electron gun comprising: a substrate of a conductive material; a plurality of emitters, each of which is of a sharp pointed shape and which are formed on a plurality of predetermined parts of said substrate for emitting electrons; an insulator film formed on a remaining part of said substrate; a first gate electrode which is formed on said insulator film so as to surround said emitters with a space left between each of said emitters and said first gate electrode and which is applied with a first voltage; and a second gate electrode which is formed on said insulator film to surround an outer peripheral surface of said first gate electrode with a distance left between said outer peripheral surface of said first gate electrode and said second gate electrode and which is applied with a second voltage less than said first voltage; wherein:

said emitters are formed on the substrate except a center part of said substrate;

said first gate electrode having an inner peripheral surface which defines a hole exposing a center portion of said insulator film that is positioned on the center part of said substrate.

2. A field emission electron gun as claimed in claim 1, wherein the conductive material of said substrate is a conductor.

3. A field emission electron gun as claimed in claim 1, wherein the conductive material of said substrate is a semiconductor.

4. A field emission electron gun as claimed in claim 1, wherein said emitters are arranged on said substrate to form a plurality of rings around the center part of said substrate.

5. A field emission electron gun as claimed in claim 1, wherein said emitters are arranged on said substrate to form a single ring around the center part of said substrate.

6. A field emission electron gun as claimed in claim 1, wherein said field emission electron gun further comprises:

a third gate electrode formed on the center portion of said insulator film with another distance left between the inner peripheral surface of said first gate electrode and said third gate electrode and which is applied with a third voltage less than said first voltage.

7. A field emission electron gun as claimed in claim 6, wherein said third voltage is not greater than said second voltage.

8. A field emission electron gun as claimed in claim 6, wherein the conductive material of said substrate is a conductor.

9. A field emission electron gun as claimed in claim 6, wherein the conductive material of said substrate is a semiconductor.

10. A field emission electron gun as claimed in claim 6, wherein said emitters are arranged on said substrate to form a plurality of rings around the center part of said substrate.

11. A field emission electron gun as claimed in claim 6, wherein said emitters are arranged on said substrate to form a single ring around the center part of said substrate.

* * * * *

UNITED STATES PATENT AND TRADEMARK OFFICE

CERTIFICATE OF CORRECTION

PATENT NO. : 5,786,657
DATED : July 28, 1998
INVENTOR(S) : Akihiko OKAMOTO

It is certified that error(s) appears in the above-identified patent and that said Letters Patent is hereby corrected as shown below:

Abstract line 18 afer "electrode" insert -- and which is applied with a third voltage less than the first voltage --

Col. 6, line 24 delete "1011" and insert -- 101 --

Signed and Sealed this

Second Day of February, 1999

*Attest:*

*Attesting Officer*

*Acting Commissioner of Patents and Trademarks*